United States Patent [19]

Proefrock

[11] 4,102,161

[45] Jul. 25, 1978

[54] ENSHROUDING LOCK DEVICE FOR PAIRED LOCKING BARS AND THE LIKE

[75] Inventor: Paul R. Proefrock, Nicholasville, Ky.

[73] Assignee: Sargent & Greenleaf, Inc., Nicholasville, Ky.

[21] Appl. No.: 857,749

[22] Filed: Dec. 5, 1977

[51] Int. Cl.[2] ..... E05B 67/16

[52] U.S. Cl. ..... 70/42; 70/54; 70/360; 70/416

[58] Field of Search ..... 70/32–34, 70/41–48, 54–56, 416, 417, 360, 418; 292/281

[56] References Cited

U.S. PATENT DOCUMENTS

| | | | |
|---|---|---|---|
| 3,820,360 | 6/1974 | Best | 70/6 |
| 4,030,321 | 6/1977 | Kenyon | 70/34 |

FOREIGN PATENT DOCUMENTS

| | | | |
|---|---|---|---|
| 324,130 | 1/1930 | United Kingdom | 70/32 |

*Primary Examiner*—Robert L. Wolfe

*Attorney, Agent, or Firm*—Mason, Fenwick & Lawrence

[57] ABSTRACT

A high security hasp-enshrouding lock for securing together a pair of companion locking bars having adjacent apertured hasp portions projecting outwardly in parallel abutment, the lock having a lock body providing with a rearwardly opening cavity to receive the alined abutting hasp portions therein shielded over most of their extent by the lock body and having a shackle bar on a pivoted shackle lever movable transversely through the cavity and hasp apertures to lock the hasp portions against withdrawal. The locking mechanism within the lock body includes a pivoted hasp clamping member along one side of the cavity having a rear portion projecting from the lock body to intercept wedge type attack tools during attempts to wedge the lock from the schackle and having a contact surface defining a side portion of the cavity. The schackle lever is moved between locked and unlocked conditions by a cylindrical actuating member movable between raised and lowered positions and having a key lock plug therein and locking pin means coactive with the housing to lock and release the cylindrical actuating member. The contact surface of the hasp clamping member is rotated toward the hasp portions to clamp them tightly against the opposite wall portion of the cavity when the hasp clamping member is moved by wedge type attack tools.

22 Claims, 9 Drawing Figures

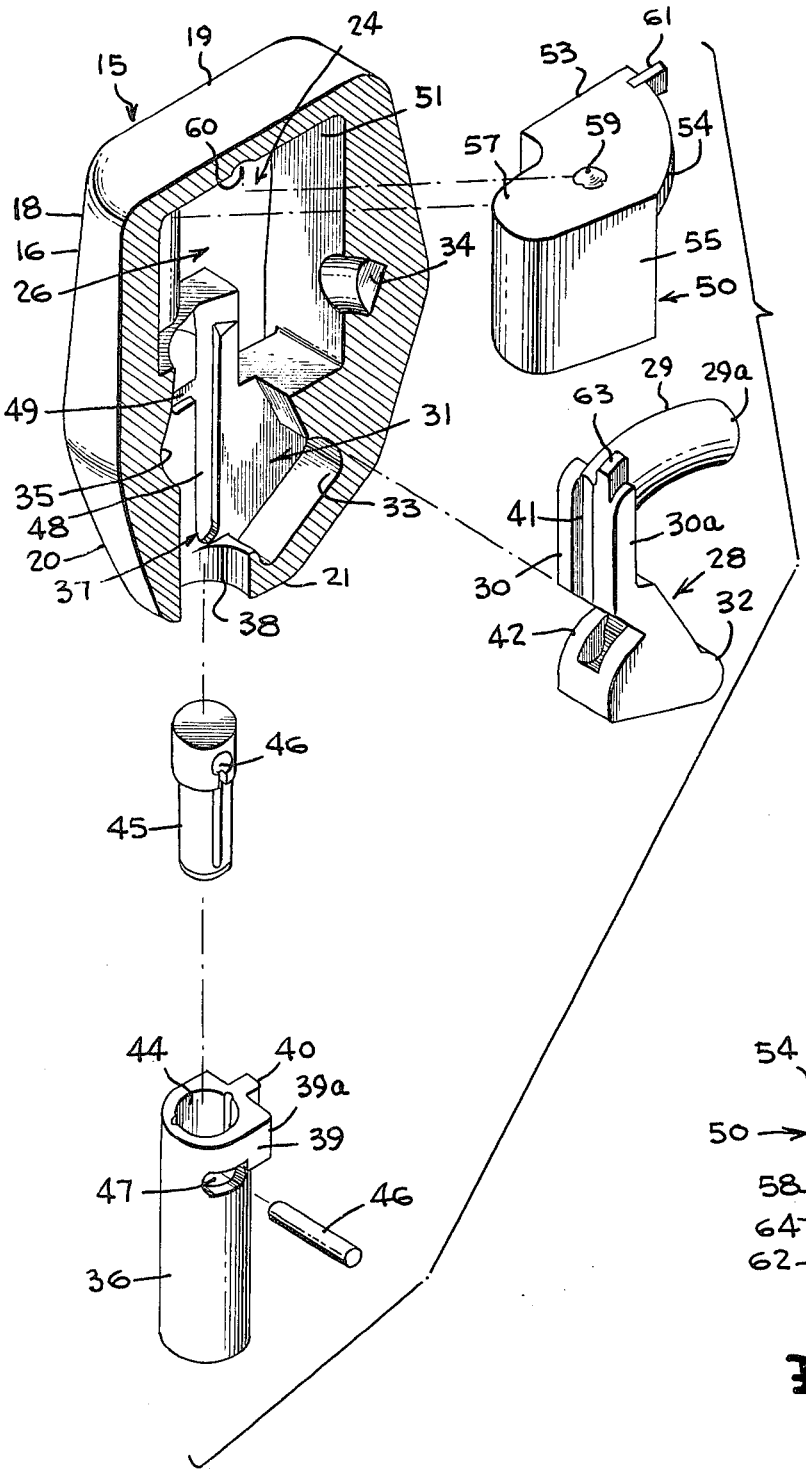
Fig-2-A
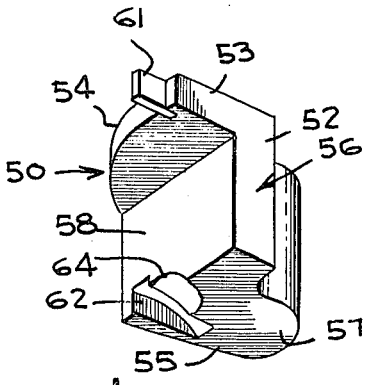
Fig-2-B

Fig-5
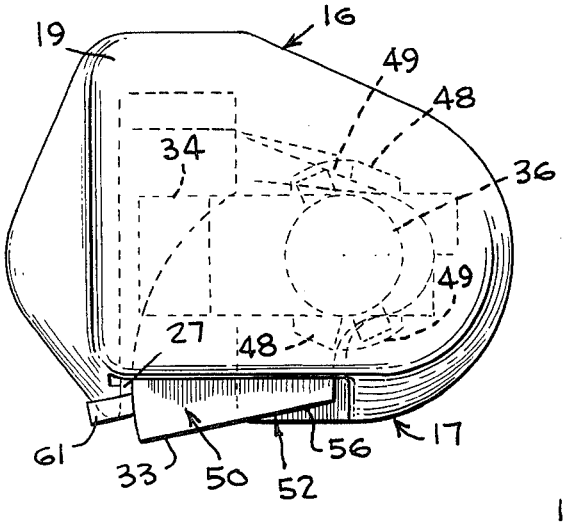
Fig-6
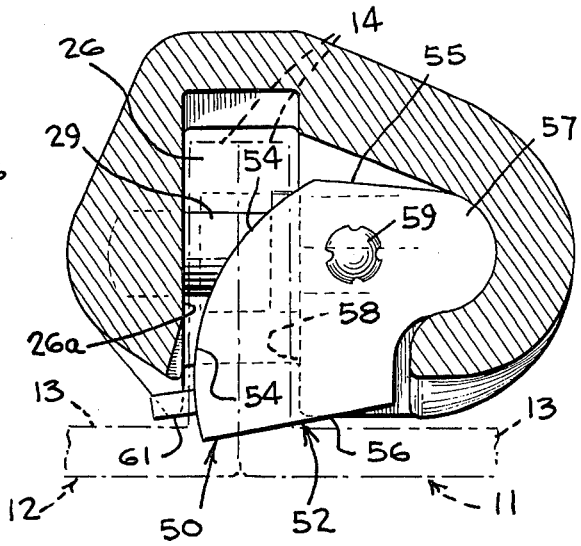
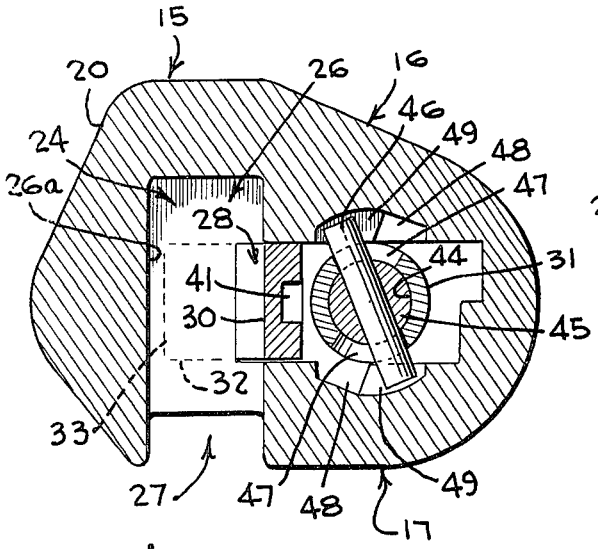
Fig-7
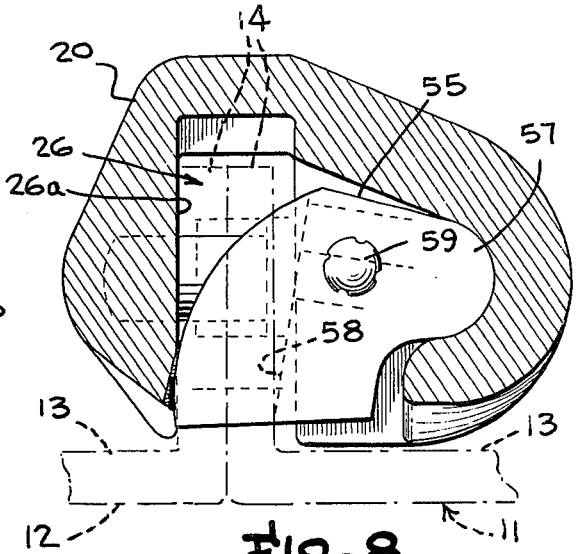
Fig-8

ENSHROUDING LOCK DEVICE FOR PAIRED LOCKING BARS AND THE LIKE

BACKGROUND AND SUMMARY OF THE INVENTION

The present invention relates in general to high security concealed shackle lock devices for use with paired adjacent staple formations of locking bars or so-called hasps, one or both of which may be L-shaped flange bars, whereby the adjacent alined staple formations receive the shackle therethrough and are surrounded forwardly and in all four lateral directions by the lock body for protection against attack by persons seeking unauthorized forced opening of the locking assembly.

The conventional type of padlock previously used with hasp and staple assemblies for locking doors, security containers and the like was of the exposed shackle type which usually included a U-shaped shackle formed of a pair of spaced parallel straight legs joined by a curved intermediate portion, together with a padlock body provided with a key lock plug or combination locking mechanism and bolt means within the padlock body for interlocking with grooves or notches in the shackle leg portions which extend into shackle sockets or openings in the padlock body. In the locked position, the exposed U-shaped shackle normally extends in exposed upstanding relation from the padlock body and is thus exposed to attack by cutting instruments or other burglary tools. In many applications where padlocks have been previously used, the padlock was in an exposed environment where it was not under constant supervision by security personnel, watchment, or people charged with protecting the area in which the lock was located. In such exposed or unsupervised padlock situations, a person seeking unauthorized entry into the space secured by the padlock had the opportunity to open the lock by any of a number of conventional techniques, such as picking, rapping, sawing, or forcing the padlock open by inserting a wedge type tool between the hasp members and padlock body or shackle to wedge or chisel the lock open.

In recent years, much effort has been devoted to improing lock security for the security enclosures in such exposed situations, by providing a pair of steel plate locking bar members, for example a pair of L-shaped steel locking bars or a paired L-shaped steel locking bar and a straight locking bar, each having a foot or base portion to be fastened by tamper-resisting screws to adjacent mounting surfaces of a pair of doors, or of a door and door jamb or comparable surface, and the plates each providing an integral outwardly projecting apertured end portion serving as a staple formation or hasp, hereinafter usually referred to as the hasp portion, to be disposed in mated or laterally alined relation and secured by a hardened high security padlock shackle or similar locking bolt. To further improve security, the naumbr of pin tumblers or levers employed in the key cylinder or key locking plug of such padlocks has been increased and the key cylinder made to resist drilling, picking and similar attack techniques. To protect the shackle against attack from the sides and from all directions by sophisticated cutting instruments, hardened padlock bodies have been developed having shroud formations which shield the sides and front of the shackle from attack by cutting instruments.

In some of such locks, the shackle is completely recessed in the padlock body in locking position and the shackle recess has a rearwardly opening slot to receive the pair of outwardly projecting apertured hasp portions of the locking bars with the shackle or bolt passed through the apertures in the hasp portions interfitted into the rearwardly opening recess of the lock body. Examples of padlocks of the shrouded type and of other lock devices designed for use with similar locking bars are found in prior U.S. Pat. Nos. 3,652,114 to Cady, 3,759,557 to Athas, 3,769,821 and 3,817,062 to Randel, 3,858,923 to Bunn, 3,901,058 and 3,996,774 to Best, 3,744,280 to Brown and 3,638,460 to Berry. FIG. 8 of U.S. Pat. No. 3,710,603 and FIG. 10 of U.S. Pat. No. 3,713,309 to Miller, both assigned to the assignee of the present application, also show shrouded shackle padlocks with a cruciform shaped recess in the upper end portion of the padlock body opening rearwardly to receive the laterally juxtaposed forwardly projecting apertured hasp portions of such locking bars.

A particular problem with these L-shaped flange type locking bars secured by padlock or enshrouding lock devices has been the ability of burglars or unauthorized persons to force the lock off of the locking bars by driving a wedge down between the rear portion of the lock body and the locking bars and thereby tear the shackle through the ear or staple portion of the locking bars and thereby destroy the holding action of the lock on the locking bars.

An object of the present invention is the provision of a novel attack-resistant concealed shackle lock construction for use with L-shaped locking bars or the like constructed with a rearwardly opening cavity to receive apertured hasp portions of the locking bars and a knuckle type attack resisting device so that attack on the lock mechansim with wedges to attempt to force it off the apertured hasp portions will further increase binding action of the lock mechanism components on the apertured hasp portions as the wedges are driven, providing additional strength and support to the locking bar hasps and shackle.

Another object of the present invention is the provision of a novel attack-resisting concealed shackle lock of the type described in the preceding paragraph, wherein the lock body is provided with a movable pivoted knuckle device having a hasp-binding surface adjacent the locking bar hasp portions to tightly bind the latter against an opposite surface of the hasp-receiving cavity and lend additional strength and support to the hasp portions for resisting ripping of the shackel from the locking bars.

Yet another object of the present invention is the provision of a novel shackle type locking device of the concealed shackle type as described in the preceding paragraph, wherein progressively tighter grasping or binding against the hasp portions is achieved responsive to movement of a wedge relative to the lock body during attempted forced entry by wedge attack, more than usual protective metal is provided around the hasps deterring saw attack, and an operating cyclinder surrounds the key lock plug to provide maximum security against picking and operate the shackle between locking and unlocking positions, and when in locked position, the cylinder is enclosed in protected relation with the lock body.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 2A is an exploded front perspective view of the concealed shackle lock device, with the housing shown in section cut through a midplane thereof;

FIG. 2B is a rear perspective view of the hinged hasp clamping member;

FIG. 5 is a top plan view thereof;

FIG. 6 and 7 are horizontal section views taken along the lines 6—6 and 7—7 of FIG. 3; and FIG. 8 is a fragmentary horizontal section view taken along the same section plane as FIG. 6, but showing the anti-wedge device in the position to which it is driven by a wedge during attack.

DETAILED DESCRIPTION OF PREFERRED EMBODIMENTS

Figure 1:
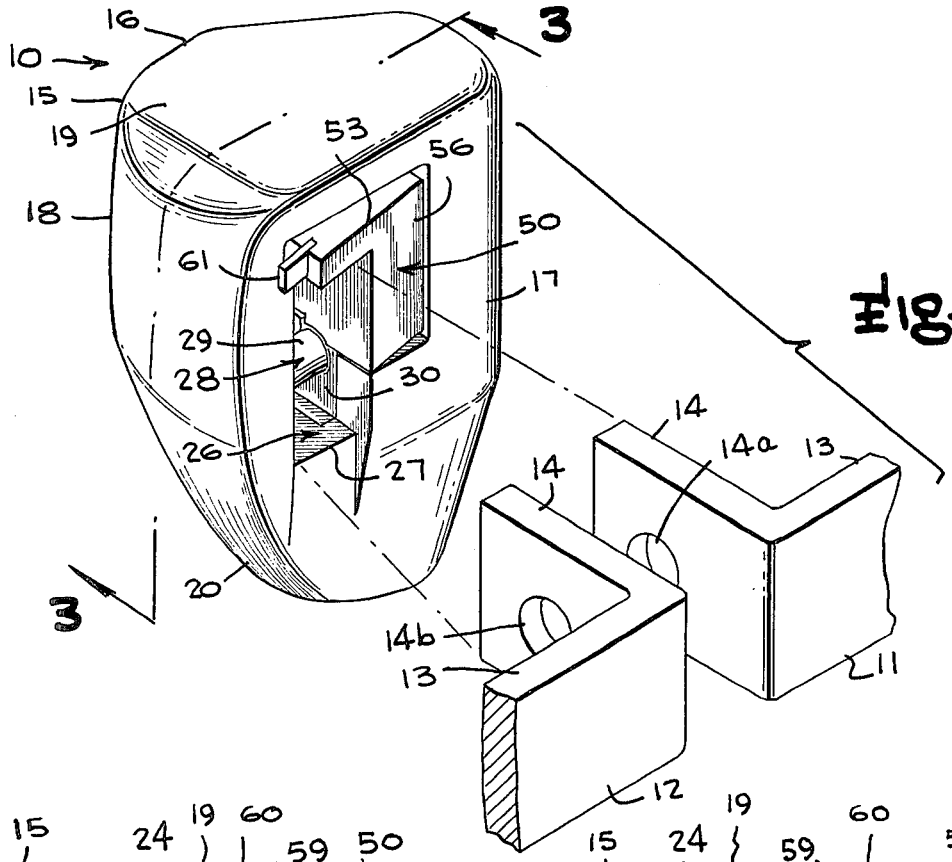
FIG. 1 is a rear perspective view of a concealed shackle lock device embodying the present invention, shown adjacent a pair of L-shaped flange type locking bars with which the same is designed to be used.
Figure 3:
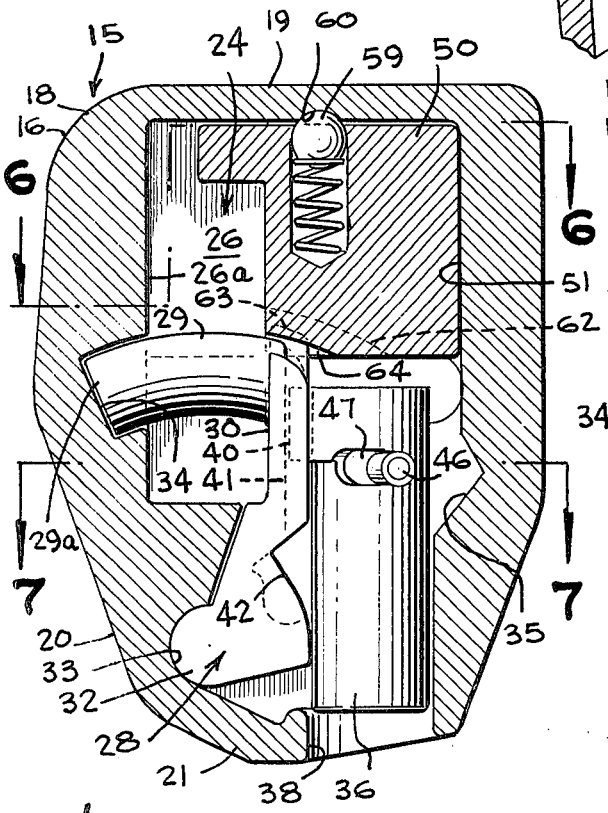
FIG. 3 is a vertical transverse section view of the lock device, taken along the transverse side-to-side axis along the line 3—3 of FIG. 1, showing the same in locked position.

Referring to the drawings, wherein like reference characters designate corresponding parts throughout the several figures, there is illustrated in FIGS. 1, 2 and 3 a concealed shackle device, indicated generally by the reference character 10, embodying the construction of the present invention and designed to be used with a pair of locking bars 11, 12 of the L-shaped flange type. The locking bars, as illustrated, are of L-shaped steel plates having a flat foot or base mounting portion 13 adapted to be secured by tamper-proof screws, not shown, to mounting surfaces, for example the forwardly facing adjacent surface portions near the meeting edge of a pair of sliding doors, and having at the ends of the mounting foot or base portions 13 which are nearest each other outwardly projecting flanges 14 which are of rectangular or near rectangular profile, forming heavy apertured outwardly projecting end portions which are hereinafter frequently called apertured hasp portions 14, designed to be abutted in side-by-side registered relation when the doors are closed to be secured tightly together in that condition. In this manner, the apertured hasp portions 14 project outwardly substantially perpendicular to the mounting surfaces of the doors to which they are secured. it will be appreciated, of course, that the base or foot portions 13 of the bars may be of other configurations than that shown in the drawings, and may, for one of the locking bars, extend rearwardly in the same plane as the outwardly projecting flange 14 of that locking bar, where it is desired to mount that locking bar on the face of a door jamb or frame surrounding the door opening and lying perpendicular to the front face of the door, in which case that locking bar serves as a conventional keeper. In either case, the apertured hasp portion 14 of the locking bar 12, whether it is an L-shaped angle member or a flat plate member, is designed to be disposed in laterally alined registering abutment with the hasp portion 14 of the companion locking bar 11 in the locked condition.

The lock body or casing 15 of the concealed shackle lock device herein illustrated is of general elliptical configuration in top plan view, having front and rear curved faces 16 and 17, an upper end portion 18 having a top surface 19, and a lower end portion 20 having a bottom surface 21. The lock body or casing 15 is preferably formed of a casted shell, formed for example of hardened steel, and shaped as illustrated in the drawings, having an interior cavity system formed therein, generally indicated by the reference character 24, specially shaped as shown herein to accommodate the various locking components of the lock device. It will be appreciated, however, that the casing 15 may be formed as a pair of mating casted half shells jointed along flat meeting faces alined with the transverse vertical mid-plane of the lock body to be secured in abutment with each other, and each of the casing halves having the appropriate parts of the cavity system formed therein.

Figure 4:
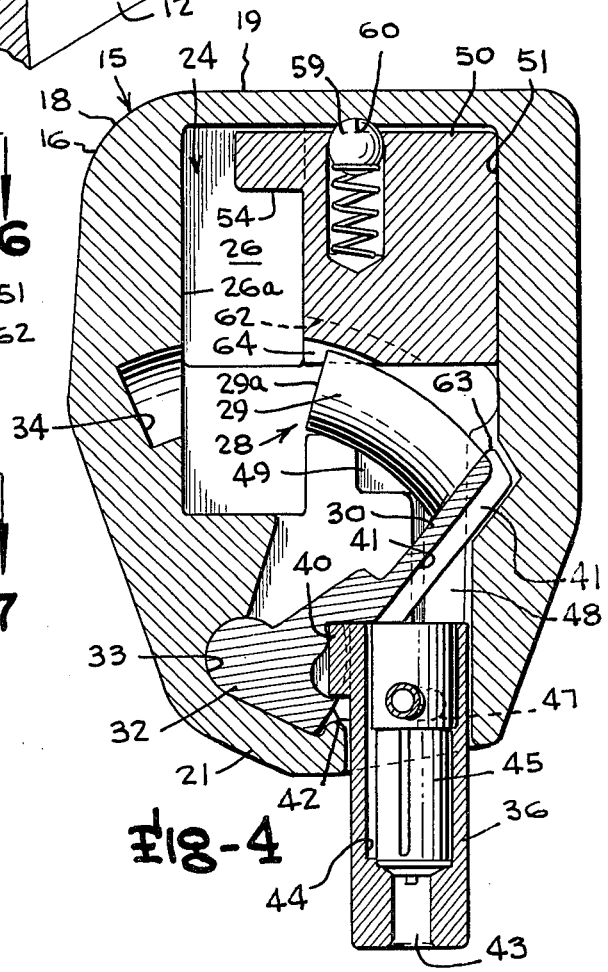
FIG. 4 is a vertical transverse section view of the lock device, taken along the transverse side-to-side axis along the line 3—3 of FIG. 1, showing the same in unlocked position.

The upper portions of the interior cavity system 24 in the casing 15 are shaped to receive the hasp portions 14 of the locking bars 11, 12 in laterally alined abutment in the hasp receiving cavity portion, indicated by the reference character 26, which occurs at the upper left hand region of the cavity system 24. The portion of the hasp receiving cavity or chamber 26, which occurs in the rearmost protion of the casing 15, extends entirely through the rear surface of the casing to provide a rearwardly facing entrance opening 27 for receiving the hasp portions 14 into the cavity 26. A shackle member 28 formed as an integral single casted member has a slightly curved shackle bar 29 adapted to be projected laterally across the hasp receiving cavity 26 at the proper position to extend through the shackle openings 14*a*, 14*b* in the locking bar hasp portions 14. The shackle bar 29 is integrally joined at one end to a lever portion 30 of the shackle member which extends downwardly into the shackle receiving cavity portion 31 of the cavity system 24 and terminates at its lower end in a rounded pivot knuckle formation 32 which is nested in a rounded socket portion 33 at the lower corner of the shackle receiving cavity portion 31 defining with the pivot knuckle formation 32 the pivot axis for the shackle member 28. The free end portion 29*a* of the shackle bar 29 is received in a socket 34 when the shackle member 28 is in the locked position wherein the straight lever arm 30*a* of the lever portion 30 extends vertically immediately alongside approximately the lower half of the hasp receiving cavity portion 26. The shackle member 28 is capable of sufficient arcuate movement to the right as viewed in FIG. 3 from the locked position to an unlocked position shown in FIG. 4, wherein the shackle bar 29 is moved sufficiently to withdraw its free end from the hasp receiving cavity portion 26, the straight lever arm 30*a* of the shackle member lever portion 30 being received in a V-notch 35 in the portion of the cavity system 24 located generally opposite the bottom of the hasp receiving cavity 26.

Located immediately to the right of the shackle member lever portion 30 when the shackle member 28 is in the locked position, as viewed in FIG. 3, is a plug encasing cylinder 36 which serves both as the enclosure for housing the key lock plug for the lock device and also serves as the manually movable operating member for moving the shackle member 28 between locking and unlocking positions. The plug encasing cylinder 36 is supported for vertically reciprocative axial sliding movement in the cylinder receiving cavity portion 37 of the interior cavity system 24 and is guided for movement between the raising locking position illustrated in FIG. 3, wherein the cylinder is entirely recessed within the lock housing 15 to protect the same against attack, and the lower unlocking position illustrated in FIG. 4, wherein the cylinder 36 projects downwardly from the opening 38 therefor in the bottom surface 21 of the lock body. The cylinder 36 has a head formation 39 at the upper end thereof providing a flat surface 39*a* facing toward the straight lever arm portion 30*a* of the shackle member 38 and having a rib or lug formation 40 projecting from the central portion of the flat surface 39*a* of the head 39 into a vertically elongated groove or tract 41 therefor in the confronting face of the shackle member lever arm 30*a*. A V-shaped notch 42 is provided in the confronting surface portion of the lever portion 30 of the shackle member spaced a short distance above the lower end thereof located so as to be engaged by the lug member 40 on the head of the cylinder when the cylinder approaches the end of its downward stroke to impart pivotal retracting movement to the shackle member 28 from the locked to the unlocked position, the V notch being sized to receive and accommodate the adjacent portions of the head formation 39 at the lower position of the cylinder.

The cylinder 36 has a key entrance opening 43 in its lower end portion to permit insertion of a key into a larger diameter bore 44 through the upper portion of the cylinder which receives a key lock plug 45, for example a key lock of the rotary disc tumbler type disclosed in earlier U.S. Pat. No. 4,008,588 to Harry C. Miller and Herman Edward Tickel, Jr., the key lock plug 45 having a transversely extending pin 46 fixed in any suitable manner to the upper end of the sleeve of the key lock plug 45 which is rendered capable of rotation with the key when the proper key has been inserted. The pin 46 is of such length that its opposite ends extend outwardly through slots 47 therefor in the side wall of the cylinder 36 and project into vertically elongated grooves 48 in confronting wall portions of the lock casing located to the front and rear of the cylinder 36. The upper end portions of the grooves 48 join horizontally extending groove portions 49 positioned to receive the ends of the pin 46 projecting beyond the cylinder 36 when the cylinder 36 is in the uppermost or locked position to accommodate rotation of the key lock plug 45 and pin 46 relative to the cylinder 36 to the locked position of the key lock plug.

Means have been incorporated in the lock device of the present invention to resist it being forcibly driven off of the locking bars 11, 12 by insertion of the sharp end of a heavy metal wedge or similar prying tool downwardly, laterally or upwardly between the wall surface of the lock body and the rearwardly adjacent surface of the mounting portion 13 of the locking bars or the surface on which the locking bars are mounted, and driving the wedge by a sledge or heavy hammering tool so as to exert sufficient outward wedging force against the padlock body to tear the shackle bar 29 forwardly through the apertured hasp portions 14. To resist destruction of the security of the lock and locking bar assembly by such wedge destruction techniques, a special hasp clamping anti-wedge device, indicated generally by the reference character 50, is pivoted by a hinge knuckle formation in the cavity portion 51 of the cavity system 24 alongside the locking bar hasp portions 14. The hasp clamping anti-wedge device 50 has a rear wall portion 52 and top overhang formation 53 normally located laterally adjacent and above the region occupied by the hasp portions 14 and extending rearwardly a sufficient distance from the rear surface of the lock body into the path of attack of the lock destroying wedges which one may attempt to insert against the rear of the lock body to cause the device 50 to be cammed forwardly for leading additional support to and exerting greater holding action on the hasp portions 14. In the illustrated embodiment, this hasp clamping anti-wedge device 50 is made in the form of a single unitary body generally resembling a truncated sector of a cylinder in top plan view having a convexly curved edge 54 defining the free edge of the overhang formation 53 and having front and rear walls 55, 56 extending along convergent paths from the curved surface 54 toward the knuckle formation 57 defining the end of the anti-wedge device opposite the overhang formation. The major part of the end of the anti-wedge device 50 below the overhang formation 53 is cut away to define a contact surface 58 below the overhang laterally bounding the hasp portions 14 to be brought into binding or holding contact against the adjacent surface of the adjacent hasp portions 14 and clamp the two laterally alined abutting hasp portions 14 between the surface 58 and the opposite side wall 26*a* of the haps receiving cavity 26 as is illustrated in FIG. 8. The anti-wedge device 50 also serves as a cover for the cylinder 36 and key lock plug 45 therein and is restrained in position against accidental dislodgement from the cavity 24 by a detent mechanism, shown in the illustrated embodiment as a spring pressed ball 59 in a cylindrical well provided in the top portion of the anti-wedge member 50 which is spring urged into a detent socket 60 in the top surface of the cavity system 24, shown in FIGS. 3 and 4. To further assist in location the anti-wedge device 50 at the desired inclined position illustrated in FIG. 6, wherein its rear wall 56 progresses rearwardly at a small angle from the knuckle end 57 of the end of the curved edge 54, a frangible lip or stop lug 61 is fixed in the overhand portion 53 and projects from the curved edge 54 beyond the side wall 26*a* of the hasp receiving cavity 26 to rearwardly overlap a portion of the rear wall of the lock body immediately adjacent the cavity side wall 26*a* and abut the same and thereby properly locate the anti-wedge device 50 in the desired rearwardly inclined position. The frangible lip or stop lug 61, however, is such as to be readily broken away when the anti-wedge device 50 is urged forwardly by an attack wedge being driven against it in the zone rearwardly of the lock body adjacent the locking bar hasp portions to permit the anti-wedge device 50 to be swung by the attack wedge or tool and thereby bring the contact surface 58 of the anti-wedge device 50 progressively toward the opposite wall 26*a* of the hasp receiving cavity to bind or jam the hasp portions 14 therebetween and resist their being forcibly withdrawn from the cavity 26 and also lend additional support to them.

Also, the bottom surface of the anti-wedge device 50 adjacent the contact surface 58 thereof is provided with a first deeper groove 62 cut along a curved path corresponding to the path of movement of the upwardly projecting ear or lug formation 63 extending upwardly from the top of the lever arm portion 30 of the shackle member 28 and a second shallower adjoining groove 64 extends along a curved path corresponding to the path of the shackle bar 29 when the shackle member 28 swings from the locked to unlocked position. The shallower groove 64 receives the upper portion of the shackle bar 29 during most of its travel from the unlocked position of FIG. 4 toward the locked position of FIG. 3, and as the shackle member arrives at the locked position of FIG. 3, the shackel bar passes sufficiently out of the shallower groove 64 to free the anti-wedge device 50 for forward movement to hasp binding position by attack wedges and the ear or lug formation 63 on the lever portion 30 of the shackle member enters and remains in the deeper groove 62. The ear formation 63 is designed to shear away during wedge attack, allowing the anti-wedge member 50 to rotate forwardly to the hasp binding position and carry out its anti-wedge function.

Assembly of the lock devices is facilitated by the particular construction hereinabove described. In order to assemble the lock, the shackle member 28 is first inserted into the cavity 24 and lowered to position its knuckle formation 32 in the socket portion 33 therefor and the shackle member swung to its locked position. The cylinder 36 with the key lock plug therein is then inserted into the cavity 24 and guided downwardly behind the shackle member into the cylinder receiving cavity portion 37. With the cylinder 36 and key lock plug in the unlocked position, with the cylinder projected downwardly to the unlocked position and the shackle member thus swung to its unlocked position, the anti-wedge member 50 is then inserted in the cavity 24 and snapped into place with its knuckle formation 57 received in the socket formation therefor and the spring pressed ball 59 snapped into the detent socket 60.

It will be appreciated that with the lock mechanism in locked condition, the lock is unlocked by inserting a proper key into the key lock plug 45 in the cylinder 36 and rotation of the key to turn the pin 46 from the locked position lying in the horizontal groove portion 49 of the locking grooves to a position alined vertically with the vertical grooves or slots 48 in the lock body. The cylinder 36 is then free to mo-e down to its downwardly projected unlocked position. As the cylinder 36 is drawn downwardly, the rib or lug 40 on the head 39 of the cylinder moves through the groove 41 and contacts the bottom surface of the V notch 42 in the shackle member 28 and swings the shackle member about its pivot axis to the unlocked position shown in FIG. 4. This movement of the shackle member 28 about the pivot axis defined by its knuckle formation 32 and the socket portion 33 of the interior cavity of the lock body retracts the shackle bar 29 from the hasp receiving cavity portion 26 and from the apertures of the locking bar hasp portions 14 therein. To relock the lock mechansim, the cylinder 36 is pushed upwardly back into the lock housing, camming the shackle member 28 back to the locked position by the action of the head portion 39 of the cylinder on the upper surface of the V notch 42. The cylinder 36 is pushed the remaining distance into the lock to its fully locked position and then by rotating the key to relock the key lock plug, the pin 46 is rotated into the horizontal groove portions 49 in the lock body, retaining the cylinder 36 in the locked position.

By the construction herein described and shown, a very secure and highly protected lock mechanism is provided, wherein the lock body is designed to provide as much metal as feasible around the hasp, and in the locked condition, the cylinder and lock body back up the shackle member and prevent it from being punched out of the way. The lock pin 46 in the cylinder 36 is arranged in such a way so that the lock body cannot be drilled and the pin removed or rotated to the unlocked position. The anti-wedge device 50, which also serves as the cover to the cylinder and shackle components of the lock mechanism, is designed so that attack on the unit with wedges to force it off the hasps will force the anti-wedge device 50 forwardly to tightly jam the pair of laterally alined abutting hasps between the contact surface 58 thereof and the opposite wall **26*a* of the hasp receiving cavity portion, providing additional strength and support to the hasp portions and the shackle. The hasp portions and shackle bar are entirely enclosed, precluding any saw attack, and the design of the shackle allows the body of the lock device to contact the hasp portions when attacked, transferring the stress created by hammer blows or torque methods of attack to the hasp portions of the locking bars. The body of the lock is shaped to provide sufficient material at high stress areas but is also contoured to resist hammer, drill, wedge or wrench attack. The cylinder 36 is designed to surround the rotating key lock plug 45, providing the maximum amount of security against picking, and the cylinder 36, when locked in the upwardly withdrawn or retracted position, is completely enclosed within the lock body and only its lower face is exposed. The cylinder member 36** is preferably formed of a material which will resist any drilling or attack through the key hole.

What is claimed is:

1. A high security hasp-enshrouding lock for securing in locked condition a pair of companion locking bars having ends providing apertured hasp portions to be locked together in adjacent vertical planes in parallel, laterally alined abutment, the lock comprising a strong penetration and distortion resistant lock casing having a rearwardly opening cavity bounded by spaced bounding wall surfaces to receive the alined abutting hasp portions therebetween in enshrouded relation shielded over most of their extent by the lock body against access by attacking tools, the lock including a shackle having a bar portion movable generally transversely relative to said vertical planes between a locking position extending transversely through the cavity and the hasp apertures and a retracted position enabling withdrawal of the hasp portion from the cavity, a locking mechanism with the lock body for locking the shackle in said locking position and releasing the same for movement to the retracted position, a wedge-attack-resisting pivoted hasp-clamping member in said cavity disposed laterally adjacent the pair of laterally alined abutting hasp portions and having a wedge-engaging surface projecting rearwardly from the lock casing for resisting destructive attack by wedge-type attack tools driven into the zone immediately rearwardly of the lock casing by persons seeking destructive tearing of the shackle forwardly through the hasp portions, the hasp-clamping member comprising a contact surface portion defining a hasp-receiving passage between the latter and an opposite wall surface of the cavity to receive the laterally alined abutting hasp portions therebetween and having pivot means defining a vertical pivot axis therefor spaced laterally of said passage providing pivotal mounting of the hasp-clamping member for lateral swinging movement in the cavity, said hasp-clamping member normally occupying a first position wherein its rear end portion projects through the rearward opening of said cavity for a predetermined distance beyond the rear of the lock casing and adjacent the alined abutting hasp portions into said zone to be engaged by the attacking tool when driven against the rear of the lock casing, the pivotal mounting of said hasp-clamping member imparting a predetermined component of lateral hasp gripping movement to its contact surface toward the opposite bounding wall surface when the hasp-clamping member is driven forwardly from said first position by the attacking tool and thereby bring the contact surface and the opposite cavity wall surface into increasingly tightening gripping engagement with the opposite lateral surfaces of said hasp portions for resisting destructive tearing and withdrawal of the hasp portions from the cavity, said locking mechanism including a clindrical actuating member supported for reciprocative axial movement in said casing along an actuator axis generally perpendicular to the transverse path of the shackle between axially spaced locking and unlocking positions and having a key lock tumbler mechanism for locking and unlocking the actuating member for movement between such positions, and means controlled by said tumbler mechanism and actuating member coactive with control surfaces on said lock casing for restraining said tumbler mechanism and actuating member at their locked positions and releasing them for manually controlled movement of the shackle to said retracted position.

2. A high security hasp-enshrouding lock as defined in claim 1, wherein said cylindrical actuating member assumes a locking position retracted entirely within the lock casing at its locking position protected from attack at the sides and top thereof by the lock casing.

3. A high security hasp-enshrouding lock as defined in claim 1, wherein said cylindrical actuating member assumes a locking position retracted entirely within the lock casing at its locking position protected from attack at the sides and top thereof by the lock casing, said lock casing having an opening in the lower end portion thereof corresponding substantially to the circular cross-section of the cylindrical actuating member for passage of the actuating member from its retracted position to said unlocking position wherein the actuating member projects from said casing over a substantial portion of its axial extent.

4. A high security hasp-enshrouding lock as defined in claim 1, wherein the pivoted hasp-clamping member has an integral overhang portion projecting from said contact surface over the pair of laterally alined abutting hasp portions and providing a ledge above the hasp-portions having its rear surface forming part of said rear end portion inclined at an angle to said adjacent vertical planes to project into the zone into which the attack tools are driven to be wedged forwardly to clamp said contact surface against the confronting hasp surface to support the latter against tearing of the shackle therefrom.

5. A high security hasp-enshrouding lock as defined in claim 2, wherein the pivoted hasp-clamping member has an integral overhang portion projecting from said contact surface over the pair of laterally alined abutting hasp portions and providing a ledge above the hasp portions having its rear surface forming part of said rear end portion inclined at an angle to said adjacent vertical planes to project into the zone into which the attack tools are driven to be wedged forwardly to clamp said contact surface against the confronting hasp surface to support the latter against tearing of the shackle therefrom.

6. A high security hasp-enshrouding lock as defined in claim 3, wherein the pivoted hasp-clamping member has an integral overhang portion projecting from said contact surface over the pair of laterally alined abutting hasp portions and providing a ledge above the hasp portions having its rear surface forming part of said rear end portion inclined at an angle to said adjacent vertical planes to project into the zone into which the attack tools are driven to be wedged forwardly to clamp said contact surface against the confronting hasp surface to support the latter against tearing of the shackle therefrom.

7. A high security hasp-enshrouding lock as defined in claim 1, wherein said hasp-clamping member has recess means for receiving the shackle bar portion in nested relation therein during movement of the shackle from locking to retracted position when said hasp-clamping member is in its normal position and includes shoulder surfaces to be disposed in intercepting relation to the path of shackle retracting movement from locking position when said hasp-clamping member is displaced forwardly from its normal position by wedge attack.

8. A high security hasp-enshrouding lock as defined in claim 2, wherein said hasp-clamping member has recess means for receiving the shackle bar portion in nested relation therein during movement of the shackle from locking to retracted position when said hasp-clamping member is in its normal position and includes shoulder surfaces to be disposed in intercepting relation to the path of shackle retracting movement from locking position when said hasp-clamping member is displaced forwardly from its normal position by wedge attack.

9. A high security hasp-enshrouding lock as defined in claim 3, wherein said hasp-clamping member has recess means for receiving the shackle bar portion in nested relation therein during movement of the shackle from locking to retracting position when said hasp-clamping member is in its normal position and includes shoulder surfaces to be disposed in intercepting relation to the path of shackle retracting movement from locking position when said hasp-clamping member is displaced forwardly from its normal position by wedge attack.

10. A high security hasp-enshrouding lock as defined in claim 4, wherein said hasp-clamping member has recess means for receiving the shackle bar portion in nested relation therein during movement of the shackle from locking to retracted position when said hasp-clamping member is in its normal position and includes shoulder surfaces to be disposed in intercepting relation to the path of shackle retracting movement from locking position when said hasp-clamping member is displaced forwardly from its normal position by wedge attack.

11. A high security hasp-enshrouding lock as defined in claim 5, wherein said hasp-clamping member has recess means for receiving the shackle bar portion in nested relation therein during movement of the shackle from locking to retracted position when said hasp clamping member is in its normal position and includes shoulder surfaces to be disposed in intercepting relation to the path of shackle retracting movement from locking position when said hasp-clamping member is displaced forwardly from its normal position by wedge attack.

12. A high security hasp-enshrouding lock as defined in claim 6, wherein said hasp-clamping member has recess means for receiving the shackle bar portion in nested relation therein during movement of the shackle from locking to retracted position when said hasp-clamping member is in its normal position and includes shoulder surfaces to be disposed in intercepting relation to the path of shackle retracting movement from locking position when said hasp-clamping member is displaced forwardly from its normal position by wedge attack.

13. A high security hasp-enshrouding lock as defined in claim 1, wherein said hasp-clamping member has recess means for receiving said shackle bar portion in nested relation therein during movement of the shackle from locking to retracting position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

14. A high security hasp-enshrouding lock as defined in claim 2, wherein said hasp-clamping member has recess means for receiving said shackle bar portion in nested relation therein during movement of the shackle from locking to retracting position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

15. A high security hasp-enshrouding lock as defined in claim 3, wherein said hasp-clamping member has recess means for receiving said shackle bar portion in nested relation therein during movement of the shackle from locking to retracting position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

16. A high security hasp-enshrouding lock as defined in claim 4, wherein said hasp-clamping member has recess means for receiving said shackle bar portion in nested relation therein during movement of the shackle from locking to retracting position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

17. A high security hasp-enshrouding lock as defined in claim 5, wherein said hasp-clamping member has recess means for receiving said shackle bar portion in nested relation therein during movement of the shackle from locking to retracted position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

18. A high security hasp-enshrouding lock as defined in claim 6, wherein said hasp-clamping member has recess means for receiving said shackle bar portion in nested relation therein during movement of the shackle from locking to retracted position when said hasp-clamping member is in its normal position, said shackle having a frangible lug formation projecting into a portion of said recess means shaped to accommodate arcuate movement of the lug during movement of the shackle between the locking and retracted positions, the lug being located to extend into said recess at said locking position, and said hasp-clamping member being shaped to present surfaces in the path of withdrawal movement of the shackle bar from locking position when the hasp-clamping member is forced forwardly from its normal position by wedge attack to resist retracting movement of the shackle.

19. A high security hasp-enshrouding lock as defined in claim 1, wherein said pivoted hasp-clamping member has a frangible lug projecting from a portion thereof remote from said pivot means to a position rearwardly overlying and abutting a rear wall portion of the lock casing immediately adjacent the rearward opening of said cavity to normally restrain said hasp-clamping member at said first position and be capable of breaking under forces applied by an attacking tool against the hasp-clamping member to release the hasp-clamping member for forward movement.

20. A high security hasp-enshrouding lock as defined in claim 4, wherein said pivoted hasp-clamping member has a frangible lug extending from said overhang portion projecting from a portion thereof remote from said pivot means to a position rearwardly overlying and abutting a rear wall portion of the lock casing immediately adjacent the rearward opening of said cavity to normally restrain said hasp-clamping member at said first position and be capable of breaking under forces applied by an attacking tool against the hasp-clamping member to release the hasp-clamping member for forward movement.

21. A high security hasp-enshrouding lock as defined in claim 10, wherein said pivoted hasp-clamping member has a frangible lug extending from said overhang portion projecting from a portion thereof remote from said pivot means to a position rearwardly overlying and abutting a rear wall portion of the lock casing immediately adjacent the rearward opening of said cavity to normally restrain said hasp-clamping member at said first position and be capable of breaking under forces applied by an attacking tool against the hasp-clamping member to release the hasp-clamping member for forward movement.

22. A high security hasp-enshrouding lock as defined in claim 16, wherein said pivoted hasp-clamping member has a frangible lug extending from said overhang portion projecting from a portion thereof remote from said pivot means to a position rearwardly overlying and abutting a rear wall portion of the lock casing immediately adjacent the rearward opening of said cavity to normally restrain said hasp-clamping member at said first position and be capable of breaking under forces applied by an attacking tool against the hasp-clamping member to release the hasp-clamping member for forward movement.

* * * * *